United States Patent [19]

Rigsby

[11] Patent Number: 4,953,867

[45] Date of Patent: Sep. 4, 1990

[54] GOLFER'S TRAINING AID

[76] Inventor: Bill B. Rigsby, 7707 Queensferry, Dallas, Tex. 75248

[21] Appl. No.: 264,776

[22] Filed: Oct. 31, 1988

[51] Int. Cl.[5] ..... A63B 69/36

[52] U.S. Cl. ..... 273/183 D; 273/163 A

[58] Field of Search ..... 273/163 R, 163 A, 194 R, 273/186 D, 164

[56] References Cited

U.S. PATENT DOCUMENTS

| | | | |
|---|---|---|---|
| 3,033,574 | 5/1962 | Partridge | 273/183 D |
| 3,198,525 | 8/1965 | Smith | 273/163 A |
| 3,253,829 | 5/1966 | Ford | 273/194 R |
| 3,262,705 | 7/1966 | Nunziato | 273/194 R |
| 3,273,892 | 9/1966 | Nolting | 273/163 A |
| 3,273,893 | 9/1966 | Duncan | 273/163 A |
| 3,298,693 | 1/1967 | Eisenberg | 273/194 R |
| 3,951,415 | 4/1976 | Stuart | 273/163 A |
| 4,053,160 | 10/1977 | Salata | 273/186 A |
| 4,116,448 | 9/1978 | Crowe, Jr. | 173/163 A |
| 4,167,268 | 9/1979 | Lorang | 273/163 A |
| 4,174,838 | 11/1979 | Paschetto | 273/163 A |
| 4,720,110 | 1/1988 | Hurst | 273/183 D |
| 4,789,158 | 12/1988 | Chiesa | 273/163 A |

*Primary Examiner*—George J. Marlo

[57] ABSTRACT

The apparatus enables the golfer in the course of a putting stroke to establish and to prolong the point of visual reference of the position of the putter face with respect to the center of the ball and the intended target line. This invention is comprised of an adjustable "L" shaped alignment member which may be affixed to the shaft of the putter proximate to the putter face to establish a visual line at a right angle to the putter face and extending from the desired point of contact with the ball through the center of the ball. The golfer aligns the putter face such that the alignment member passes above the center of the ball in line with the intended path of the ball. The extension of the alignment member allows the golfer to determine when the line of the putting stroke or position of the putter face varies from the line established at address (the act of initially aiming the putter) because the length of the alignment member will exaggerate any movement of the putter face to a position that is not perpendicular to and in a direct line with the line established at address. Failure to maintain the putter face position with the target line throughout the stroke will invariably result in an "offline" or missed putt.

4 Claims, 1 Drawing Sheet

GOLFER'S TRAINING AID

BACKGROUND

Typically, putting represents approximately one half of the total stroke score in a round of par golf. It is necessary to develop a putting stroke that is true in terms of the intended target path of the ball while maintaining the putting face perpendicular to that line of travel if one is to be able to play par golf since very slight deviations from the such stroke produces greater misses as the distance of the intended putt increases. The conventional putter provides no way for the golfer to measure or comprehend straight line accuracy of the putting stroke.

SUMMARY OF PRESENT INVENTION

The present invention provides the golfer with an uncomplicated means of learning to align the putter face and in training the putting stroke to follow a straight line true to the original target line while maintaining the putter face perpendicular to that target line.

Figure 1:
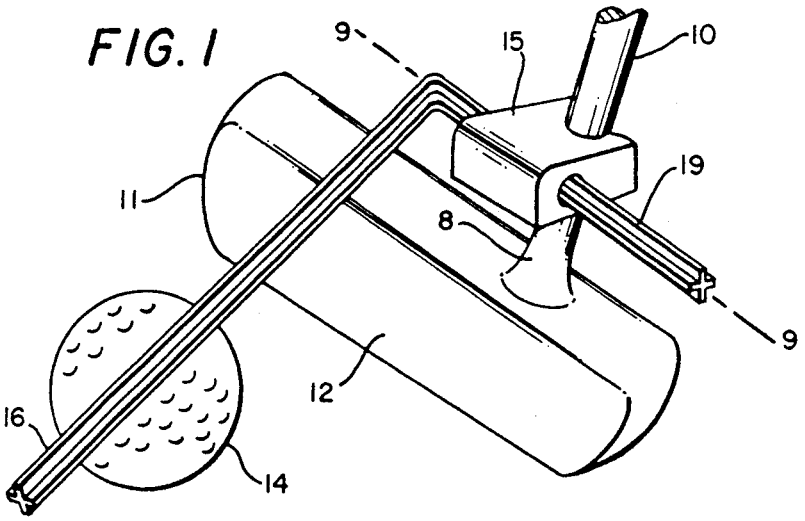
FIG. 1 is a perspective illustration showing the head portion of a typical putter, illustrating the golf ball, and the attachment constructed in accordance with the principles of the present invention.
Figure 2:
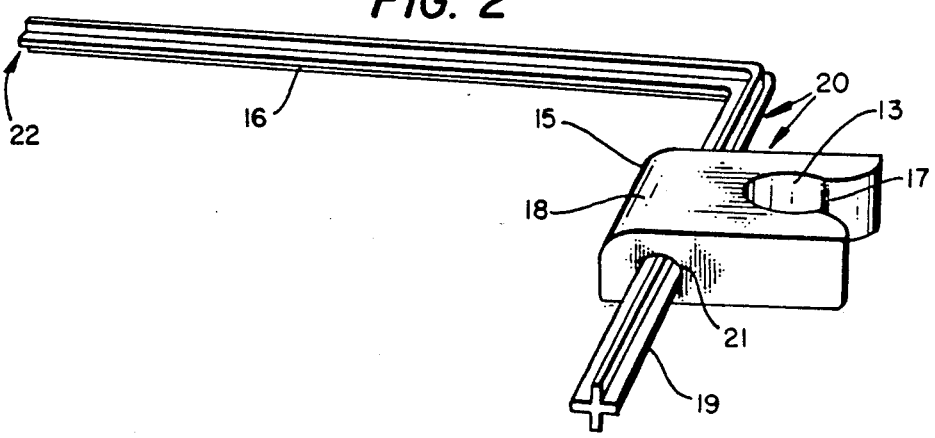
FIG. 2 is a view of the attachment by itself with the two component parts attached.
Figure 3:
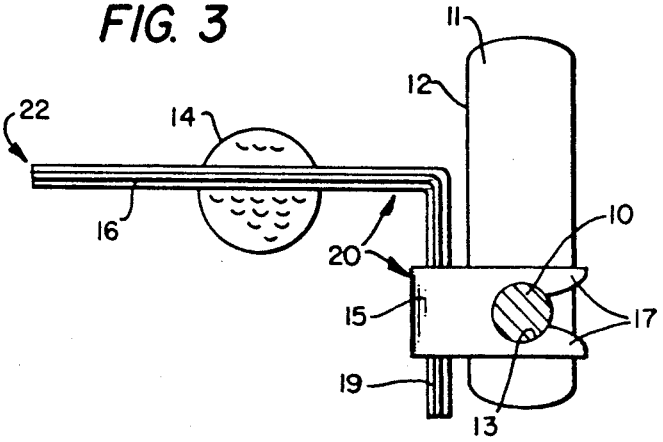
FIG. 3 is a horizontal cross-sectional view taken substantially on line 9—9 of FIG. 1.

With reference now to FIGS. 1 to 3, inclusive, and particularly to FIGS. 1 and 2 it will be noted that the putter comprises a conventional shaft 10 having the usual hosel 8 or equivalent connector joined with a putter head 11, and the ball striking or impacting surface of which is denoted at 12. The golf ball is denoted at 14.

The entire device of the attachment member 20 consists of two principal components or parts one of which provides a readily applicable and removable attachment bracket denoted generally by 15 and the complementary part constituting the sighting, lining up and indicating pointer this being denoted by 16. The attachment bracket is of a one-piece construction and is preferably made of lightweight durable but moldable plastic material. At one end a generally C-shaped attaching opening 13 is provided. The attaching opening 13 is of general C-shaped form as at 13 and 17 to accommodate the shaft in the manner shown in FIGS. 2 and 3. The resilient gripping jaws are denoted at 17, and these are appropriately shaped to provide the gripping action required to maintain original position. Jaws are flanged outwardly and away from each other to assist in applying and removing the attachment bracket 15 and consequently, attachment member 20. The front portion 18 of the attaching bracket is provided with an opening 21 to accommodate the inside arm 19 of the alignment piece 22. An infinite number of adjustments are permitted by sliding inside arm 19 through attachment bracket front opening 21 for horizontal adjustments and by moving entire attachment member bracket 15 vertically up or down the putter shaft 10 for vertical adjustment.

In FIG. 3 it is to be noted that the pointer 16 is such that it projects at right angles beyond the forward face 12 of the putter head 11. This is significant because when the putter head is drawn back, that is, in a direction away from the ball and is then moved forwardly again, the user can, by maintaining the desired line of sight, focus upon both the pointer and the ball, and can move the putter relative to the ball in properly oriented association. The device can be used as a practice and training device. It is not intended for use in actual play because rules prohibit attachments to putters which are adjustable or removable.

What I claimed is:

1. In a conventional type golf ball putter having a hand held shaft terminating in a putter head with a ball striking face, the improvement comprising, in combination:

a. a bracket slideably engaging said shaft, b. a pointer having an integral L-shaped arm slideably engaging said bracket, c. a C-shaped opening and a lateral opening in said bracket d. resilient gripping jaws surrounding said C-shaped opening and adapted to instantly retain said bracket at selected vertical positions on said shaft, e. common means for both slideably adjusting said arm in said lateral opening for aligning said pointer horizontally with a target line between a golf ball and toward a golf cup, and for rotating said pointer to a vertical position for storage.

2. In a conventional golf ball putter having a hand held shaft terminating in a putter head with a ball striking face, the improvement comprising:

b. a bracket of pliable material, slideably engaging said shaft for vertical movement along said shaft and above the location of a golf ball on the ground, b. an alignment piece comprising a pointer and an arm slideably and rotatably engaging said bracket, c. a C-shaped opening and a lateral opening in said bracket for moveably gripping said shaft and arm respectively, d. means for aligning said pointer horizontally above the center of said golf ball and an imaginary target line from the ball toward a golf cup.

3. In a conventional golf ball putter having a hand held shaft terminating in a putter head with a ball striking face, the improved training means, comprising:

a. a one-piece pliable bracket slideably engaging said shaft, b. an alignment piece comprising solely a pointer and an arm slideably and rotatably engaging said bracket, c. a shaft clamping opening in said bracket, and d. an alignment piece engaging opening in said bracket adapted to position said pointer of said alignment piece in alignment with the center of a golf ball and an imaginary target line toward a golf cup for training purposes.

4. In a conventional golf ball putter having a hand held shaft terminating in a putter head with a ball striking face, the improved training means, comprising in combination:

a. an attachment member comprising a one-piece pliable bracket slideably engaging said shaft, and b. an alignment piece comprising solely a one-piece pointer and an arm combination having a multipoint support star cross-section slideably and rotatably engaging said bracket for infinite positioning steps thereon, c. a shaft clamping opening in said bracket for attaching to said shaft without tools, d. an alignment piece engaging opening in said bracket adapted to position the pointer of said alignment piece in alignment with the center of a golf ball, e. whereby, a golfer may practice putting strokes by guiding a putter along a target line defined by said pointer aligning from above the center of a golf ball toward a golf cup.

* * * * *